US011110943B2

(12) United States Patent
Wolber

(10) Patent No.: US 11,110,943 B2
(45) Date of Patent: Sep. 7, 2021

(54) LOCKING DEVICE ON TWO BODIES MOVABLE IN A SLIDING MANNER RELATIVE TO EACH OTHER ON A GUIDE TRACK

(71) Applicant: WOLBER ANTRIEBSTECHNIK GMBH, Velbert (DE)

(72) Inventor: Rainer Wolber, Essen (DE)

(73) Assignee: Wolber Antriebstechnik GmbH, Velbert (DE)

( * ) Notice: Subject to any disclaimer, the term of this patent is extended or adjusted under 35 U.S.C. 154(b) by 286 days.

(21) Appl. No.: 16/082,617

(22) PCT Filed: Mar. 6, 2017

(86) PCT No.: PCT/DE2017/000056
§ 371 (c)(1),
(2) Date: Dec. 12, 2018

(87) PCT Pub. No.: WO2017/152894
PCT Pub. Date: Sep. 14, 2017

(65) Prior Publication Data

US 2019/0092358 A1 Mar. 28, 2019

(30) Foreign Application Priority Data

Mar. 7, 2016 (DE) ..... 10 2016 002 624.3

(51) Int. Cl.
*B61L 5/10* (2006.01)

(52) U.S. Cl.
CPC ..... *B61L 5/10* (2013.01)

(58) Field of Classification Search
CPC .... B61L 5/10; B61L 5/02; B61L 5/065; B61L 5/107; B61L 11/04; E01B 7/02; E01B 2202/08; E01B 7/00; E01B 2202/042
See application file for complete search history.

(56) References Cited

U.S. PATENT DOCUMENTS 4,842,225 A * 6/1989 Carmes ..... B61L 5/065 246/439
4,896,850 A * 1/1990 Carmes ..... B61L 5/107 246/476
5,620,156 A * 4/1997 Berggren ..... B61L 5/10 246/221

(Continued)

FOREIGN PATENT DOCUMENTS

DE 1263063 * 3/1968 ..... E01B 7/02
DE 2606664 A1 8/1977

(Continued)

OTHER PUBLICATIONS

International Search Report for International Application No. PCT/DE2017/000056 dated Jul. 4, 2017.

*Primary Examiner* — Mark T Le
(74) *Attorney, Agent, or Firm* — Alston & Bird LLP

(57) ABSTRACT

A locking device on two bodies movable in a sliding manner relative to each other on a sliding track has a locking pin (7) which is guided in a straight-line mechanism in the guide body transversely with respect to the sliding track and is movable in the expelling direction. A socket spanner is guided in a sliding manner parallel to the sliding direction in the guide body. The locking pin (7) projects with an actuating end into a pocket of the socket spanner. The pocket has edges and surfaces for expelling and inserting the locking bolt and for blocking the straight-line mechanism. The locking device is suitable in particular for the connection and aligning movement of two guide bodies as occur in particular in a point operating mechanism.

7 Claims, 6 Drawing Sheets

(56) References Cited

U.S. PATENT DOCUMENTS

| | | | | |
|---|---|---|---|---|
| 8,672,274 | B2 * | 3/2014 | Albisua Aspiazu | B61L 5/10 246/468 |
| 9,238,474 | B1 | 1/2016 | Carpenter | |
| 2004/0069911 | A1 * | 4/2004 | Schnedl | B61L 5/04 246/448 |

FOREIGN PATENT DOCUMENTS

| | | | | |
|---|---|---|---|---|
| DE | 29610175 | * | 8/1996 | B61L 5/10 |
| DE | 19840328 | C1 | 3/2000 | |
| DE | 102013009395 | A1 | 12/2013 | |
| DE | 102013009166 | A1 | 12/2014 | |
| EP | 1348606 | A1 * | 10/2003 | B61L 5/10 |
| EP | 1348606 | A1 | 10/2003 | |
| FR | 3003531 | A1 * | 9/2014 | B61L 5/065 |
| FR | 3003531 | A1 | 9/2014 | |

* cited by examiner

LOCKING DEVICE ON TWO BODIES MOVABLE IN A SLIDING MANNER RELATIVE TO EACH OTHER ON A GUIDE TRACK

CROSS-REFERENCE TO RELATED APPLICATIONS

This application is a national stage application filed under 35 U.S.C. § 371 of International Application No. PCT/DE2017/000056 filed Mar. 6, 2017, which application claims priority to German Patent Application No. 10 2016 002 624.3 filed Mar. 7, 2016, which applications are each hereby incorporated by reference in their entireties.

FIELD OF INVENTION

The invention relates to a locking device on two bodies slidingly movable relative to each other on a guide track.

Of these bodies, one, the sliding body, slides relatively to the other on the sliding track of the other, of the guiding body. In the sliding direction, the sliding body is movable up to an end position. There it is locked and form-fittingly connected to the guiding body through the locking device in its sliding direction and/or against its sliding direction.

BACKGROUND

It is a common technique that the locking device has a locking pin, which is guided by a straight guide in the sliding body transversely to the guide track, and that in driving-out direction it is movable between a neutral position, in which it recedes into the contour of the sliding body in the region of the guide track, and a locking position, in which the locking end 22 of the locking pin form-fittingly, lockingly cooperates with an engagement 12 with the guiding body in the sliding direction 5.

As an engagement here, a machine element or hole or slot or groove or limiting- or adjacent surface on the guiding body is indicated with a locking surface, which is transverse to the sliding direction and form-fittingly cooperates with the locking end 22 of the locking pin in the socket spanner.

For example, a man can think of a door that can be closed by a latch.

Now, a door is freely accessible, so that the latch—in this application, indicated as a locking pin—can be pulled out of its engagement by hand or by a pluggable spanner in the door.

The engagement can be withdrawn. This accessibility is not possible with machines.

In particular, with many machines, the manual operation is not possible, when it comes to connecting a slidingly movable part with another form-fittingly.

BRIEF SUMMARY

The object of the invention is to design a locking device according to the preamble in such a way that a sliding body can be form-fittingly fixed on or at its guiding body without the need of installment, which are attached to a sliding body and/or guiding body from outside, which increase the structure-scale or which hinder the handling, operation and function of the sliding body and/or guiding body.

This object is achieved, e.g. and in particular by a switch machine for the switch of a railway track, which is connected to the switch blades of the switch for the shift at one of the end positions—by the switch, referred to as the installation positions—by an axially displaceably mounted adjusting rod, perpendicular to the railroad track, which is form-fittingly fixed at each of the end positions/installation positions by means of a stationary blocking device and must also be set for safety.

Such a switch has the advantage that it can be used with high frequency in accordance with safety regulations, since it is ensured by the form-fitting engagement that the adjacent switch blade cannot be released unintentionally due to the bending or vibration of the tracks.

This switch has the disadvantage that it is not "blunt, which means it can be driven up in the opposite direction.

Either the switch must be changed for operating in the opposite direction, or devices must be provided to cancel the form-fitting between the adjacent blade and the track, e.g., to release a clamping.

These devices are additionally attached to the switch machine and also are locally accommodated.

For a switch machine, which is mounted between the rails of the switch and therefore is particularly compact—see e.g., DE102013009395A1 and DE102013009116A1—and moreover, instead of maintenance or repair, can be easily exchanged, i.e., such external devices, not integrated in the machine, are not only disturbing but also questionable when concerning safety.

From the description of DE102013009395A1 and DE102013009116A1, reference is expressly made with this application, since the invention particularly builds this switch machine and the attachment of the switch machine between the rails of the switch is possible.

The solution is achieved for a generally useful machine element of the embodiments described herein, for its application to a switch machine as described.

The machine parts used here for the generation or release of the form-fitting, namely

- the socket spanner, which is slidingly guided in the sliding body parallel to the sliding direction,
- the locking pin, which protrudes with its operating end in the pocket of the socket spanner,
- the pocket, which is formed in the socket spanner, and performs several functions by the relative movement between the socket spanner and sliding body by cooperating with the locking pin in the smallest dimensions, is characterized by the fact that they are integrated into a sliding body and have no need of separate space.

These parts can also be installed in existing machines.

Thus, the function of this machine can be extended without interference with their basic structure.

The pocket in the socket spanner has surfaces and edges in the cross-section lying in the insertion direction, which cooperate with it, depending on the location and the movement direction of the socket spanner, and perform different functions on the locking pin, namely:

- a pushing action in the movement direction of the relative movement between the socket spanner and the sliding body, e.g., the insertion direction.

For this purpose, an action pairing, called push-action pairing—serves as surfaces and/or edges, one of which is a pushing-edge running transversely to the relative movement direction, which form-fittingly engages with the straightly guided region of the locking pin in the insertion direction, and by this locking pin, the sliding body and the socket spanner form-fittingly connects in one of the relative movement directions.

The driving-out of the locking pin out of the contour of the sliding body into its locking position for the form-fitting connection of the sliding body to the guiding body in at least one movement direction of the relative movement between the guiding body and sliding body.

For this purpose, an action pairing, called a lock-action pairing—serves as surfaces and/or edges on the operating end of the locking pin on the one hand and the pocket on the other.

This action pairing has a driving-out surface to the driving-out direction, preferably inclined at 45°.

The driving-out surface is on the locking pin and/or the pocket.

Anyway, a driving-out edge is a part of the surface pairing, which is on the side of the pocket, facing away from the pushing edge—in the insertion direction.

The locking of the retraction movement of the locking pin in its locking position.

For this purpose, an action pairing, called a lock-action pairing—serves as surfaces and/or edges, the locking surface, which adjoins the driving-out edge and is aligned transversely to the straight-guide of the locking pin and engages the end of the locking pin in its locking position.

The retraction/driving-in of the locking pin from its locking position into its neutral position.

For this purpose, an unlock-action pairing (30,20) serves as two edges and/or surfaces, slidingly movable relatively to each other, which lie in the plane stretched by the straight guide (8) of the locking pin and the sliding track (3) of the sliding body, and which have an operation direction for the straight guide of the locking pin—preferably inclined at 45°, Such a driving-in surface can be formed at the operating end of the locking pin or on the guiding body.

By retracting the socket spanner, the locking pin plunges into the contour of the sliding body by getting into an outer sac of the pocket, intruding only into the straight guide of the sliding body and does not protrude above.

Thus, in the direction of the relative movement, the sliding body/socket spanner is form-fitting via the pushing edge and the locking pin.

The outer sac goes to its other side in the above-mentioned pushing edge

With an appropriate relative movement of the socket spanner to the sliding body, the pushing edge takes the locking pin and this takes the sliding body, so that during the movement of the sliding body, this slides on this pulling surface in the direction of its straight guide and disappears into the outer sac of the pocket.

Thus, the form-fitting is canceled, and the sliding body can be moved freely on the guiding body in the sliding direction by more or less.

In order to prevent the locking pin from assuming an undefined position, the engagement (12) of the guiding body (4) is double-sidedly formed according to the embodiments described herein as a tapered hole or groove with tapered flanks 30, so that the locking pin is driven into its neutral position (10) during each relative movement of the guiding body (4) and sliding body (2).

In some embodiments, the invention also solves the problem in order to form-fittingly set a movable body at an end position between two stops, in particular during a sudden action of an external force, but it allows the free movement of the body out of the end position without canceling the form-fitting connection.

This situation occurs particularly in switch machines, when a form-fittingly abutting and fixed switch without the operation of the switch machine is operated from behind, i.e., is driven up.

For a solution, the movement of the sliding body is performed at the end position by driving the guiding body in a force-fitting connection to the sliding body and operating the socket spanner, so that the locking pin is driven out into its locking position.

Now that the guiding body is form-fittingly fixed, a form-fitting force-flow from the sliding body to the guiding body is generated.

By moving the socket spanner in the other direction by means of external force and accordingly driving the locking pin into its neutral position, the form-fitting is canceled, and the sliding body is pulled out through the socket spanner from the end position This invention is applied to a switch machine according to the embodiments described herein.

It is important for two sliding body slidingly movable relative to each other on a guide track to be connected to each other, so that in each case one is form-fittingly connected to the common guiding body, so that the other is fixed only with force-fitting and remains movable after its overcoming, and so that the form-fitting of the other is released by its movement, and both sliding bodies are moved synchronously.

In this solution, the lock spanner and the locking device can be doubled according to any one of the preceding embodiments by mirroring, so that the socket spanner is designed as mirror images at the ends and performs the same function, but in opposite directions respectively in one and the other sliding body.

In the above-mentioned switch machine, this results in a further problem, not only the movement previously described or the form-fitting for each of both switch blades to be ensured but also the operation for normal synchronous movement of both switch blades in the regular track switch adjustment.

For this purpose, the socket spanner 13L and 13R are connected by a central body and movable and drivable in both insertion directions and sliding directions.

For this purpose, the central body is force-fittingly connected to the guiding body 4.

This is movably guided parallel to the moving direction of the sliding body, and with a linear drive, e.g., an aligned rack 24 in the sliding direction is equipped. The rack is drivingly connected to a drive motor.

Thus, the guiding body 4 is movable between the end positions of the switch blades and form-fittingly fixed at each of the end positions by each locking blade 26 of a blocking device, so that the form-fittingly abutting switch blade on the track in the opposite direction is form-fittingly held with the guiding body, via the sliding body connected to it and the straight-guided locking pin in it.

In this case, the form-fitting between the locking pin and the guiding body is generated by plunging the socket spanner deep into the insertion end of the sliding body, by which the locking pin is driven out and is held by the locking surface 19 in the locking position 11 there.

In this case, the 45° oriented action edges/action surfaces are inclined in the pockets and to the locking pin, so that with a larger depth of plunge of the socket spanner, the locking pin is driven out into its locking position and is pulled at a lower depth of plunge in its neutral position.

The other sliding body connected to the non-adjacent switch blade remains freely movable for a dead path, which is defined by the free space of straightly guided locking pins at this sliding body in its pocket of the socket spanner.

The non-adjacent switch blade can therefore move over this dead path when the switch is driven up blunt.

During this movement, the locking pin, straightly guided in its sliding body, engages behind, after the dead path, the pushing edge 16 in the pocket of the socket spanner, pulls it out of the insertion end of the other form-fittingly fixed sliding body, thereby pulls away the locking surface 19 under the locking pin, pulls back the locking pin by sliding on the driving-in surface 20 in the contour of the sliding body and thereby releases the form-fitting of the non-adjacent switch blade.

Also, these can now be driven up blunt up to the other end position of the switch, wherein the force-fitting between the guiding body and the central body is released with socket spanners.

Through its operation, now the guiding body is also driven into its other end position, there the force-fitting to the socket spanner is generated again, while the socket-spanner is inserted into the sliding body of the non-adjacent switch blade, and the form-fitting is now generated at the now adjacent switch blade, as described above.

BRIEF DESCRIPTION OF THE DRAWINGS

In the following, the invention will be described with reference to the drawings. It shows FIG. 1A-D, FIG. 2 A-D schematic diagrams of the locking device in the cross section in a plan view, FIGS. 3A-3D and 4A-4D sliding body, guiding body and locking device on a smaller scale, however in more detail, FIG. 5 the switch machine with a view into the housing, FIG. 6 the schematic diagram of a switch.

For functionally equivalent parts, the same reference numerals are used in the following.

The description applies to all figures, unless it is pointed out to the particularity of a figure.

DETAILED DESCRIPTION

FIGS. 1 A-D and 2 A-D show a locking device 1 for a sliding body 2 in the form of an adjusting rod.

The sliding body is straightly guided to the guiding body 4, a machine part with a guiding connector.

The sliding body 2 is movable from end position 6 to the left—in FIGS. 1 A-D and 2 A-D.

In the end position 6, the sliding body is form-fittingly fixed. For this purpose serves

Figure 1A:
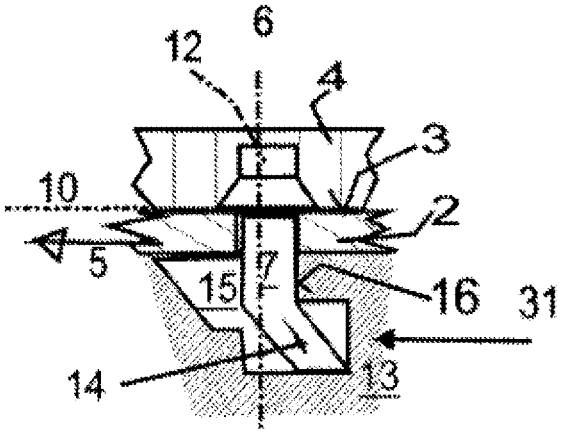
Figure 1B:
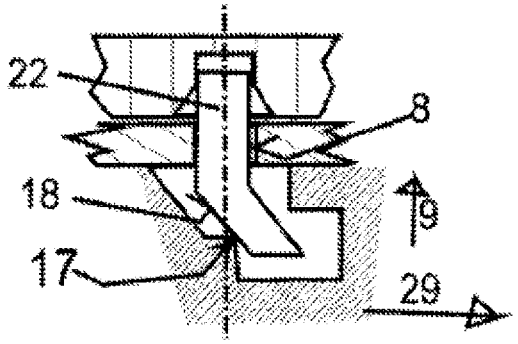
Figure 1C:
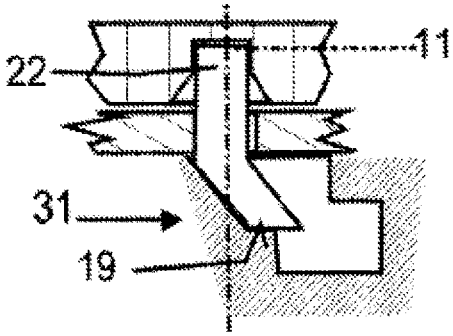
Figure 2A:
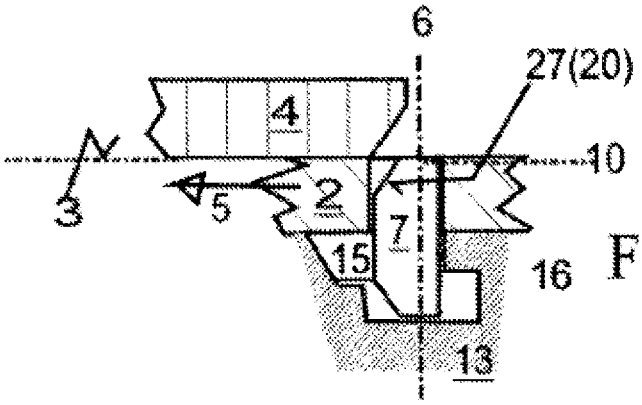
Figure 2B:
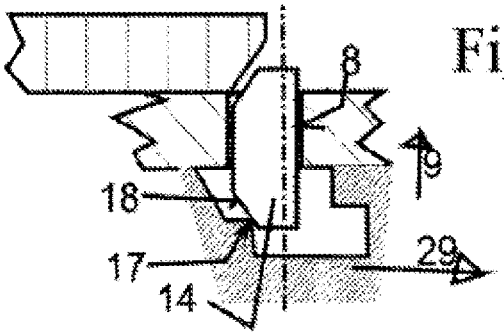
Figure 2C:
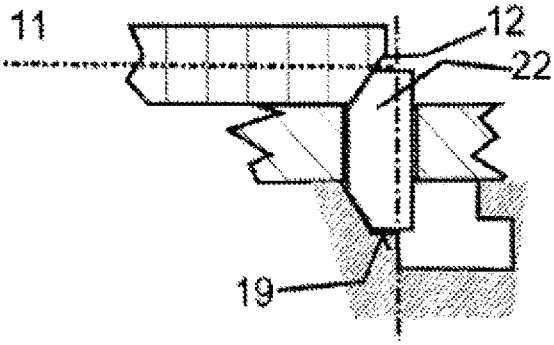

- in FIG. 1C, the locking device in cooperation of the locking pin 7 with a fixing hole (engagement 12) in the slide track 3 of the guiding body 4,
- in FIG. 2C, the locking device is in cooperation of the stopper 27—here a 45° inclined stop surface of the locking pin 7—with the back side of the guiding body 4—here locking surface 19, inclined at 45° like the stop surface 27.

For the operation of the locking pin 7 in the direction of the straight guide, the locking device has a socket spanner 13, which can be inserted deep in the socket-spanner, from the operating side of the sliding body forth in the movement direction of the sliding body in the insertion direction—deep plunge depth—and the other way around further pulled out—low immersion depth.

In this case, the relative position of the socket spanner 13 in the sliding body is such that (see FIGS. 1B and 2B), the locking pin 7 is driven into its locking position 11 by the cooperation of the driving-out edge 17 at the socket spanner 13, and the driving-out surface 18 inclined at approx. 45° to the sliding direction and straight guide of the locking pin at the front of the locking pin 7, each seen in the movement direction of the sliding body 2.

The locking pin 7 is straightly guided in the sliding body, preferably in the perpendicular direction to the movement direction of the sliding body and is freely movable between two end positions, namely

- the locking position 11, in which it protrudes from the contour of the sliding body 2 into the slide track 3 of the guiding body 4 and
- The neutral position 10, in which it is retracted into the contour of the sliding body 2 and releases the relative movement between the guiding body 4 and sliding body 2.

The locking pin in FIG. 1 A-D is perpendicular to the extending plane, but a short plate of sufficient thickness; they must be able to withstand the bending- and shearing forces, which occur in the sliding track during the relative movement of guiding- and sliding body. It is bent about half their height by about 45°.

It forms, with the bent region on the side facing the pushing edge 16, the driving-in surface 20, which cooperates with the driving-in edge 30 at the inner end of the pushing surface (FIG. 1D) and forms the drive-action pairing.

The back side of the bent region, which faces the driving-out edge 17, forms the driving-out surface 18, which cooperates with the driving-out edge 18 and forms the driving-out-action pairing.

The locking pin in FIG. 2 A-D is a round cylindrical pin of a sufficient thickness; it must be able to withstand the bending- and shearing forces that occur in the sliding track during the relative movement of guiding- and sliding body.

But, on both end surfaces, limited by the same cylinder barrel lines, the locking pin has a chamfer of approximately 45° extending the respective end surfaces intersecting perpendicular to the plane.

Figure 2D:
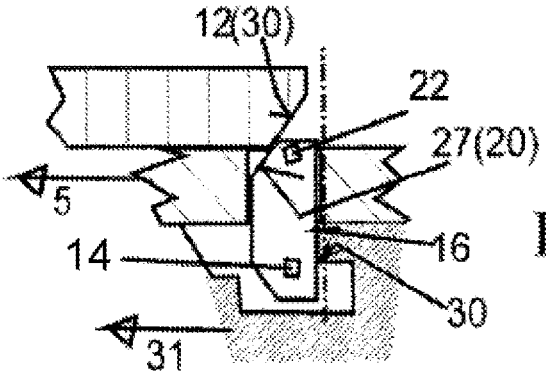
Figure 3A:
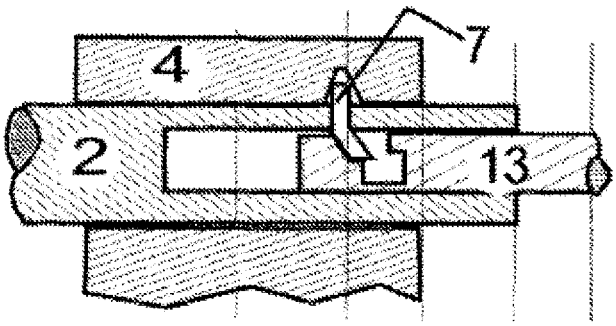
Figure 3B:
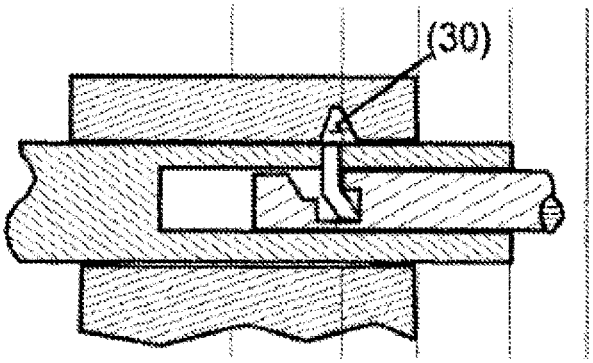
Figure 3C:
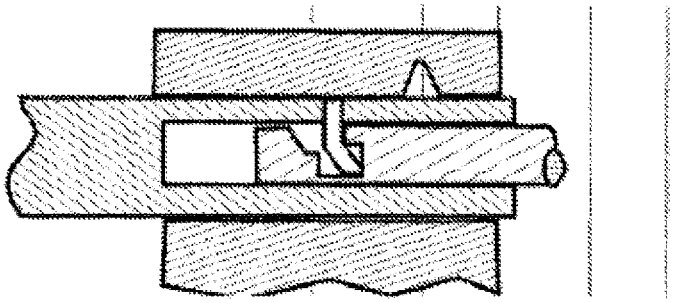
Figure 3D:
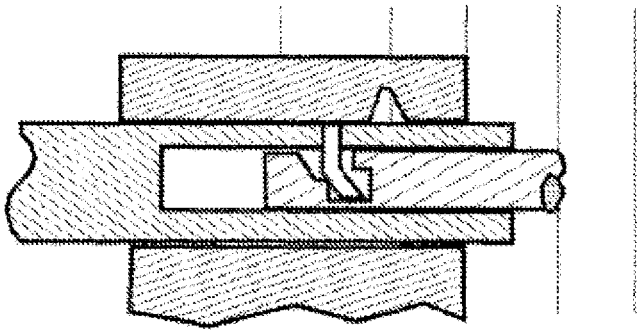
Figures 4A, 4B, 4C, 4D:
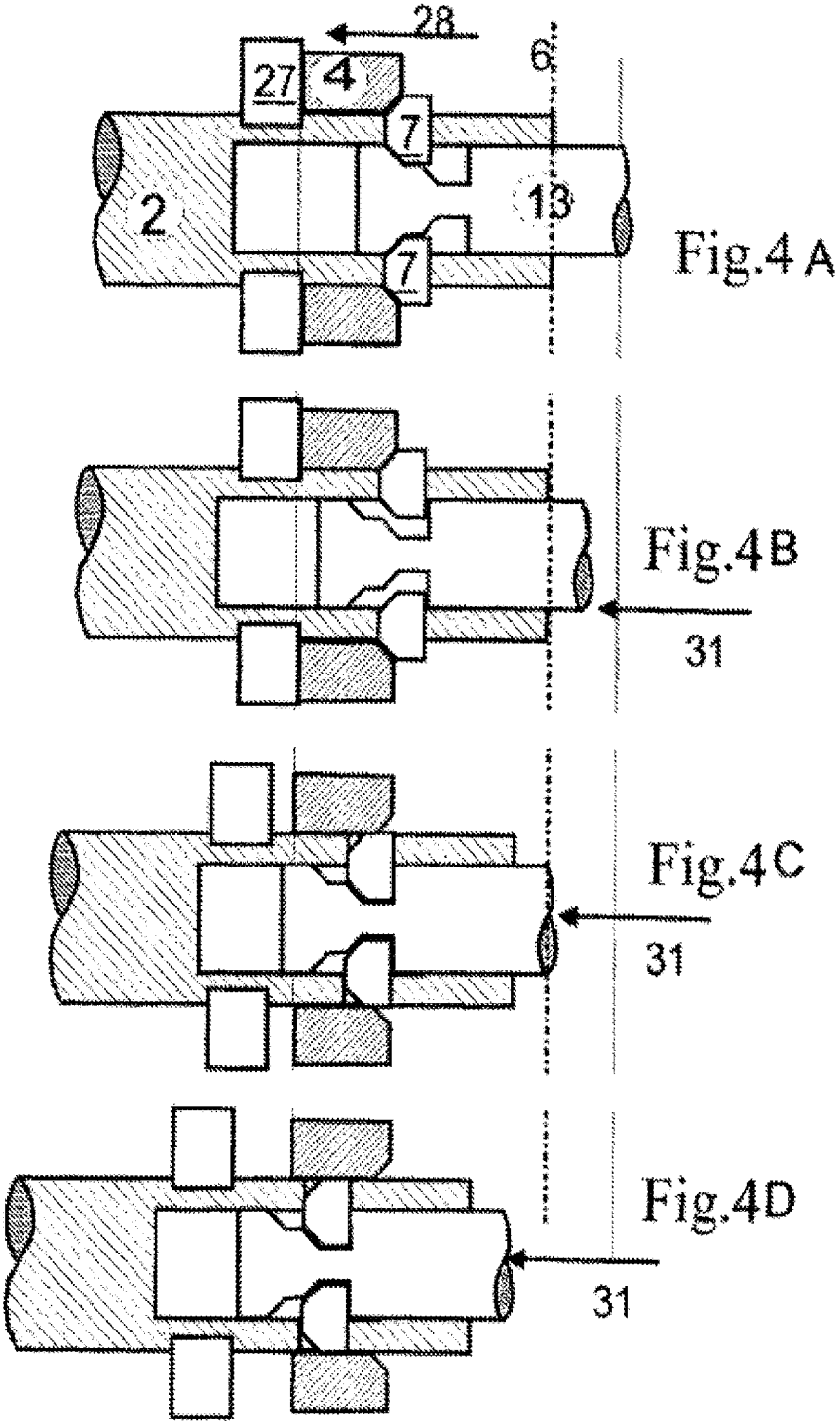

The chamfer at one locking end 22 forms the driving-in surface 20, which cooperates with the engagement 12 on the guiding body as a driving edge 30 and forms the drive-action pairing. (FIG. 2D).

The chamfer at the other operating end 14 of the locking pin serves as driving-out surface 18, which cooperates with the driving-out edge 17 of the pocket and forms the drive-out-action pairing (FIG. 2B).

It should be emphasized that the described driving-in and driving-out pairing each consist of a surface and at least a cooperating edge. Both are regularly exchangeable —edge instead of surface and vice versa.

However, a pairing can also consist of two same oriented surfaces.

To determine the active function of driving-in/driving-out of the locking pin regarding the relative movement of the socket spanner/sliding body, a horizontal mirroring of the locking device is performed.

In order to perform its locking functions, the socket spanner 13 has a pocket 15, into which the operating end 14 of the locking pin protrudes. The contour of this pocket in the axial plane of the sliding direction 5 is shown enlarged in FIGS. 1 A-D and FIGS. 2 A-D, and the functions of the edges or surfaces of the pocket are described in the following with reference to FIGS. 1 A-D, 2 A-D.

In FIGS. 1A, 2A, the locking pin 7 is retracted, so that it does not cooperate with the guiding body.

By moving the socket spanner in the sliding direction 5, the pushing edge 16 of the pocket engages behind the straight, straightly guided region of the locking pin, and this engages behind its straight guide 8 in the sliding body 2. The socket spanner, locking pin and sliding body are form-fittingly connected against the relative sliding direction 5, and are therefore synchronously movable in the sliding direction 5.

In FIGS. 1B, 2B, the locking pin is driven out of its pocket in the direction of locking.

For this purpose, the socket spanner is moved in the closing direction 29, so that the driving-out edge 17, lying opposite to pushing edge 16, cooperates with the driving-out surface 18 inclined at 45° to the locking end 22 of the locking pin 7 in the meaning of driving-out up to—as Shown in FIGS. 1C, 2C—the locking pin 7 is completely moved out of the contour of the sliding body, into the engagement 12 (FIG. 1C), form-fittingly engages with the guiding body 4 or form-fittingly grips the stop surface 12 (FIG. 2C) on the guiding body 4, in this case, it is hindered by the locking surface 19 when driving into the pocket, and then the relative movement between the sliding body and guiding body is form-fittingly locked against the displayed relative movement 5.

Figure 1D:
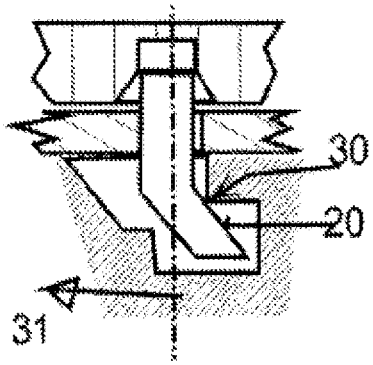

In FIGS. 1D, 2D, it is shown that only the socket spanner 13 is moved into the unlocking-direction 31 –thus, against the closing direction.

In FIG. 1D, thereby the driving-in edge 30 adjoining the pushing surface 16 is brought in an operative connection to the driving-in surface 20, lying —preferably—45° to the straight guide 8 of the locking pin.

In FIG. 2D, thereby the stop surface 12 on the guiding body as driving-in edge 30 is brought in an operative connection with the driving-in surface 20 lying —preferably—45° to the straight guide 8 of the locking pin, on the locking end 22 of the locking pin 7.

The locking pin is pulled back until it reaches the position shown in FIGS. 1A, 2A (see above).

The FIGS. 3A-3D and 4A-4D show the sliding body, guiding body and locking device in the same positions as before.

In FIGS. 3 A-D, the engagement 12 in the guiding body 4 is a conical hole or a groove with flanks 30, which conically taper to each other in cross-section, which lies in the plane of movement. If the locking pin is engaged by the locking surface 19 (FIG. 3A), it form-fittingly prevents the relative movement between the sliding body and the guiding body in both directions, if not, the two flanks act as driving-in edges, which press them into their neutral position (FIG. 3B).

In FIGS. 4 A-D is shown that the relative movement between the guiding body 4 and the sliding body 2 in one end position (4A), on the one hand by a stop 27 fixed on the sliding body, and on the other hand, by the locking pin 7 adjacent to the other site—here in the embodiment of FIGS. 2 A-D relative to the sliding body in both directions, is form-fittingly fixed at a low plunge depth of the socket spanner in the sliding body.

By increasing the plunge depth by force 31 acting on the socket spanner, the locking pin can be pulled into the neutral position (FIG. 4B-C), and the sliding body can be moved by the force 31 acting on the socket spanner in the unlocking direction 31 into this direction relative to the guiding body.

Figure 6:
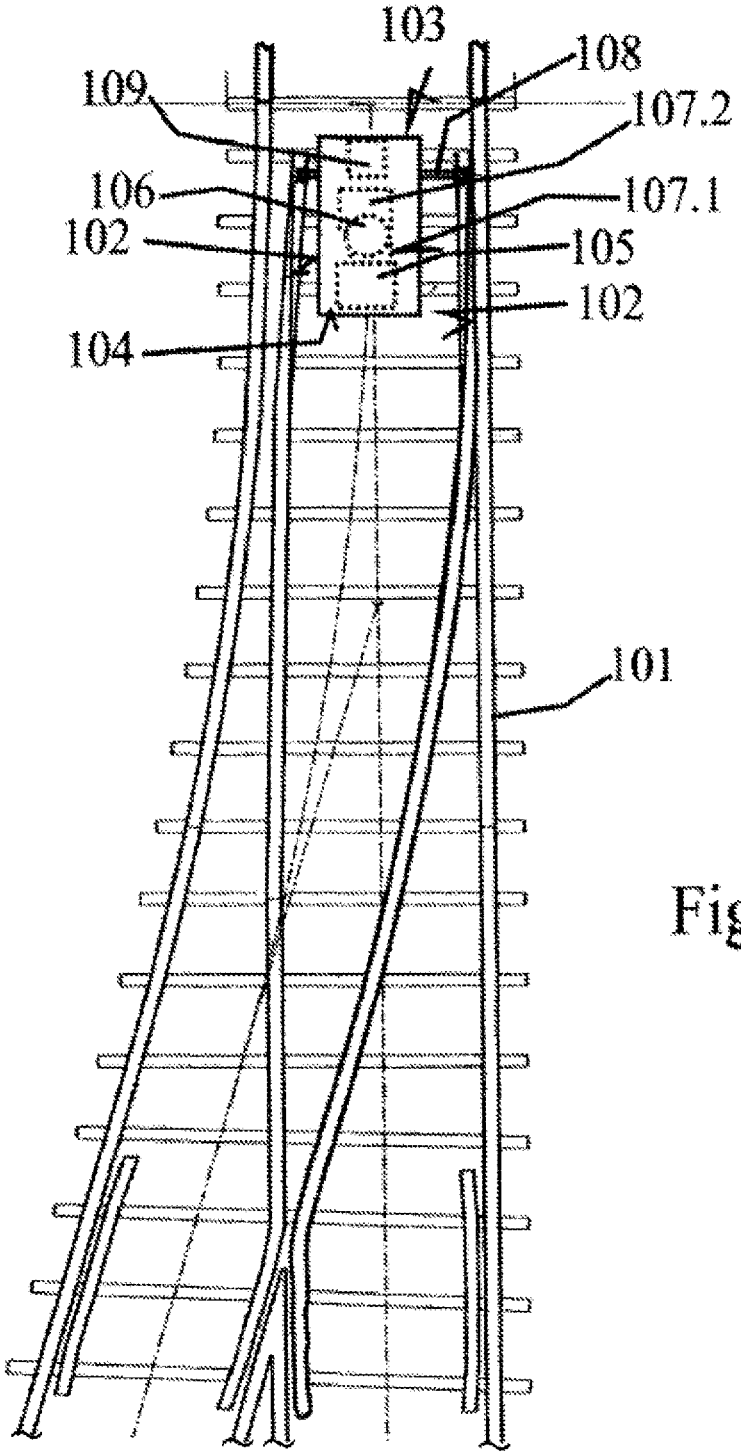

To build the switch, the illustration of the principle of a switch, of the associated switch machine as FIG. 6 and the following description is taken from the DE102013009395A1 and DE102013009116A1:

FIG. 6 shows a switch in a plan view. The switch blades 102 can be brought by the switch machine 103 alternately into contact with the left rail or right rail 101—as in FIG. 6

The switch machine is in this embodiment, which is particularly suitable for tight situations, between the two switch blades. The adjusting rod 108 of the switch machine 103 is connected to both switch blades.

The switch machine 103 is housed in a drive housing 104. The closed state is shown.

Therefore, the individual parts of the switch machine, namely, a drive motor 105, a gear train 107.1, a power limiting clutch 106 and a gear train 107.2 as well as a blocking device 109 are only indicated.

These parts are described in DE102013009395A1 and DE102013009116A1, and reference is made to this in its entirety.

This indicated switch machine can be modified by replacing the adjusting rods according to the invention, hereinafter referred to and described as sliding body, the insertion of the locking device 1 according to the invention, consisting of double-sided sockets spanner 13 and locking pin 7—as now be described with reference to FIG. 5.

The following reference numeral designates as synonyms the functionally identical elements and parts from the referenced DE102013009395A1 and DE102013009116A1 (see above).

For this purpose, a mirror image duplication of the locking devices and socket spanner described above is done, wherein the mirror plane is the central radial plane of the adjusting rod of the known switches machine. In this case, the adjusting rod is divided into two sliding bodies 2L and 2R, which lie with their insertion end 23L and insertion end 23R spaced apart.

The insertion ends are connected by the socket spanner 13L or 13R at both end surfaces of the central body 113, which is also mirrored at the said mirror plane —thus centrally between the eyelets 108.1 and 108.2. Thereby, the switch blades and the fixedly connected sliding body (2L, 2R) therewith are connected to each other, so that they are synchronously displaceable between the adjacent positions by the switch machine —except for a small dead path —described in the following-constantly maintained distance, and are also movable independently of each other, by force exerted on the switch blades when operating the switch, within the limits of the relative mobility of socket spanner and sliding body, predetermined by the locks.

In the sliding bodies 2L and 2R, locking pins 7L and 7R are straightly guided, which, as described above for FIGS. 1 A-D and FIGS. 2 A-D, but are performed mirrored at the mirror plane and are inserted.

The locking pins 7L and 7R protrudes with their operating ends into the pockets 15L or 15R at the respective left and right ends of the socket spanner.

The pockets 15L or 15R are performed—as described but are mirrored at the mirror plane. In this case, the pockets are arranged, so that the pushing edges 16L and 16R are pointed to the common mirror plane. The well-known blocking block functions here as a guiding body 4.

It is via a force-fitting latching pairing (StdT.: 13)—here schematically illustrated and referred to with 113 for a latching roller, a latching groove, a guide track and a pressing spring—instead of the adjusting rod with a gliding body between the insertion ends in the region of the socket spanner 13, lying in the mirror plane.

The guiding body 4 is also movable between two end positions in the sliding direction 5, which are form-fittingly fixed by blocking tabs 109L and 109R.

The blocking tabs 109 are operated—as described in StdT before the end sites of the guiding body 4, in order to set the end position of the adjacent switch blade, form-fittingly and stationary. As the operation of the guiding body 4, a rack and a gear are indicated.

Figure 5A:
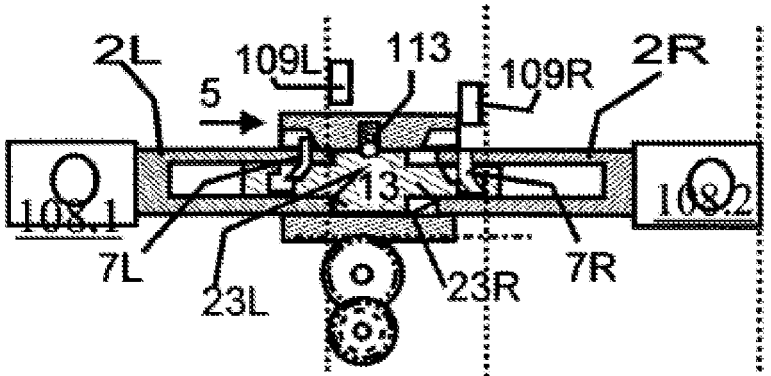

In FIG. 5A is shown that the guiding body 4 has been moved to the left in order to set the left switch blade form-fittingly.

For this purpose, the guiding body 4 is engaged behind by the driving-in blocking tab 109R right; the locking pin 7L is driven out and is hindered by the locking surface 19 at retraction.

It lies on the engagement 12L left on the guiding body 4.

It is understood that the mobility of the adjacent switch blade itself and thus also the sliding body are form-fittingly limited through the abutting rail, to which a switch blade abuts.

FIGS. 5 C and D show the process that the switch is shifted over to the right. For this purpose, the guiding body 4 is moved right by means of a rack, by the operation while maintaining the force-fitting connection to the socket spanner 13 by a latch pairing 113 B, after previously the blocking tab 109R has been released. The intermediate state is shown in FIG. 5C, the end position right in 5D.

Now the blocking tab 109L is moved in front of the end site of the guiding body 4 and locking pin 7R is supported on the right side of guiding body 4 at its engagement 12R.

Figure 5B:
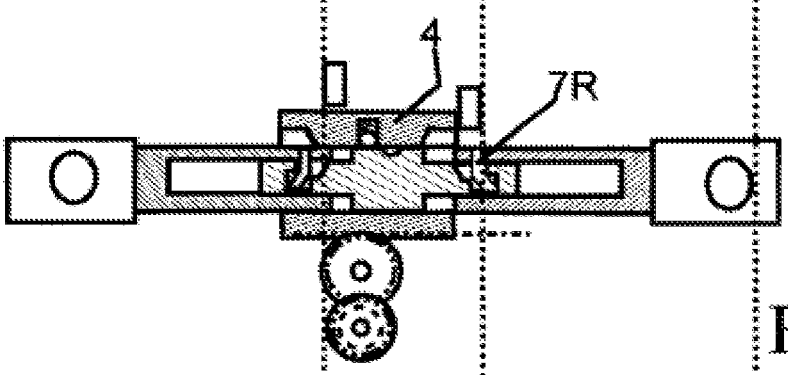
Figure 5C:
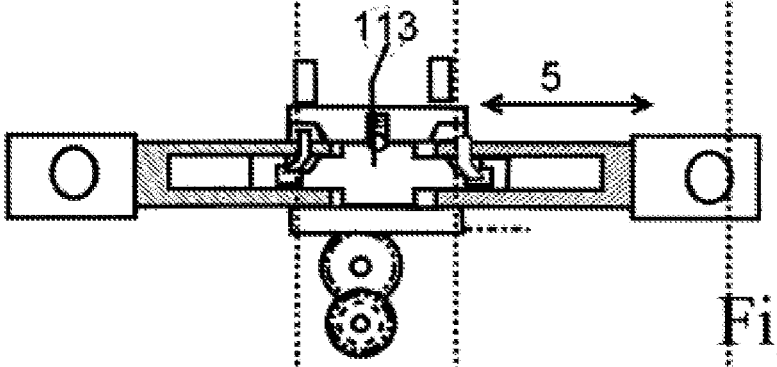
Figure 5D:
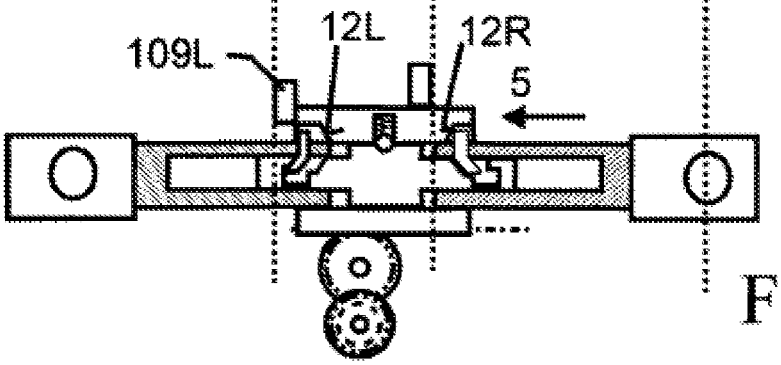

FIG. 5B shows that the switch is driven up blunt to the left adjacent switch blade.

In this case, first, the non-adjacent (=remote) right switch blade is moved in the direction on its associated track. This movement is transmitted to the sliding body 2R, which also takes away the socket spanner to the right by means of the locking pin 7R and pushing edge 16R.

By the movement of the socket spanner 11 to the right, the driving-in edge 30R of the pocket 15R comes into an operative connection to the driving-in surface 20R of the locking pin 7R.

Therefore, the locking pin is 7R is retracted behind the contour of the sliding body 2R and now form-fittingly engaged between the sliding body 2R and socket spanner 13R.

Since the guiding body 4 is still fixed by the blocking tab 109R, the latch pairing 113 is overcome.

By the movement of the socket spanner 11 to the right, the driving-in edge 30L of the pocket 15L comes into an operative connection to the driving-in surface 20L of the locking pin 7L.

The locking pin 7L is therefore retracted behind the contour of the sliding body 2L and now the form-fitting engagement of the adjacent switch blade 25L is canceled and they can also be driven up blunt.

The switch machine ensures that all security-relevant parts, and in particular, the locking pins are also operated during normal operation, so that they stay mobile and their mobility is continuously monitored.

An exception is the locking pin, e.g., 7R in the operation phase according to FIG. 5A. In this relative position of the sliding body 2R and the socket spanner, the locking pin has an undefined position in the direction of its sliding guide. To avoid this, the engagements 12R and 12L may be formed double-sidedly on the guiding body 4 as a tapered hole or groove with tapered flanks 30, as shown and described with reference to FIGS. 3 A-D, in particular, FIG. 3B.

As a result, this is driven-in by any relative movement between the sliding body 2R/2L and the guiding body of the locking pin at least into its neutral position.

For switches, which are operated with high frequency, in the said prior art, devices signals their electrical output, the blunt-moving-up, and then give up the controlling device of the switch machine, in order to start the switch and drive back to their starting position. This device is unnecessary for the driving-up blunt here.

| REFERENCE NUMERALS | |
|---|---|
| Locking device 1 | 1 |
| Sliding body 2 | 2 |
| Sliding track 3/sliding bar 16 | 3 |
| Guiding body 4 | 4 |
| Sliding direction 5 | 5 |
| End position 6 | 6 |
| Locking pin 7 | 7 |
| Straight guide 8 | 8 |
| Driving-out direction 9 | 9 |
| Neutral position 10 | 10 |
| Locking position 11 | 11 |
| Engagement of the guiding body 12 | 12 |
| Socket spanner | 13 |
| Operating end, locking pin end | 14 |
| Pocket of the socket spanner 15 | 15 |
| Pushing edge 16 | 16 |
| Driving-out edge 17 | 17 |
| Driving-out surface inclined at 45° 18 | 18 |
| Locking surface 19 | 19 |
| Driving-in surface 20 | 20 |
| | 21 |
| Locking end | 22 |
| Insertion end | 23 |
| Stop of the guiding body 4 | 27 |
| Fixing hole | 28 |
| Closing direction | 29 |
| Driving-in edge | 30 |
| Unlocking direction | 31 |
| Railway track, switch | 101 |
| Switch blade | 102 |
| Switch machine | 103 |
| Housing | 104 |
| Electrically operated drive motor | 105 |
| Abutting position (106L and 106R) | 106 |
| Gear | 107 |
| Adjusting rod eyelet | 108 |
| Blocking device blocking tab | 109 |
| Supporting frame | 110 |
| Rack | 111 |
| Blocking block | 112 |
| Central body | 113 |
| Latching pairing | 114 |
| Movement direction, application direction | 115 |
| Opposite direction, driving up direction | 116 |

The invention claimed is:

1. A locking device on two bodies slidingly movable relative to each other on a sliding track of a guiding body, the two bodies comprising a sliding body and the guiding body, wherein the sliding body is movable in a sliding direction on the sliding track of the guiding body, and wherein the sliding body is lockable and form-fittingly connectable to the guiding body by the locking device in an end position, wherein the locking device has a locking pin, which, in the sliding body, movable transversely to the sliding track via a straight guide, is form-fittingly guided transversely to a movement direction of the locking pin, between a neutral position, in which the locking pin retracts into a contour of the sliding body while being in a region of the sliding track, and a locking position, in which the locking pin cooperates with an engagement of the guiding body and form-fittingly locks a relative sliding movement of the sliding body in the sliding direction, wherein a socket spanner in the sliding body is straightly guided in a sliding manner parallel to the sliding direction, with a relative movement in a closing direction and an unlocking direction, wherein the locking pin with an operating end protrudes in a pocket of the socket spanner, wherein the pocket cooperates with the locking pin:

with an unlock-action pairing out of two edges and/or surfaces slidingly movable relatively to each other in a plane stretched by the movement direction of the locking pin and the sliding direction of the sliding body, and wherein the unlock-action pairing have a first operation direction for a straight guidance of the locking pin, as well as with a push-action pairing with a pushing-edge, which is formed on the pocket transversely to the sliding direction of the sliding body and transversely to the closing direction, and which engages the straightly guided region of the locking pin in the closing direction, wherein by the movement of the socket spanner, in an unlocking direction, initially the locking pin is drivable into its neutral position and then the sliding body is movable in the sliding direction by a form-fitting engagement of the pushing edge simultaneously with the socket spanner, but independently of the guiding body;

with a drive-out-action pairing out of two edges and/or surfaces slidingly movable relatively on each other in a plane stretched by the movement direction of the locking pin and the sliding direction of the sliding body, and the drive out action pairing have a second operating direction for the straight guide of the locking pin, wherein one driving out surface of the drive out action pairing is inclined for the straight guide of the locking pin and wherein the one driving out surface on the side facing away from the pushing edge and the unlock-action pairing—in the closing direction—is formed, on the one hand, at the pocket and on the other hand, on the locking pin;

as well as with a lock-action pairing with a locking surface formed subsequently to the drive-out-action pairing on the pocket, transversely to the straight-guide of the locking pin, and which engages the operating end of the locking pin in its locking position, wherein by the movement of the socket spanner initially the locking pin in closing direction can be driven into its locking position and therein by the locking surface can be form-fittingly fixed.

2. The locking device according to claim 1, wherein a driving-in surface is formed on the guiding body, and either on a locking end of the locking pin protruding into the engagement, the driving-in surface cooperates with this engagement in a sense of driving-in, or at an operating end of the locking pin protruding into the pocket, the locking pin cooperates with a driving-in edge at the pushing edge in another sense of driving-in.

3. The locking device according to claim 1, wherein the engagement of the guiding body is configured double-sidedly as a tapered hole or groove with tapered flanks, so that the locking pin during each relative movement of the guiding body and the sliding body can be driven by the tapered flanks.

4. The locking device according to claim 1, wherein the sliding body, by an operation of the guiding body, is movable in a movement direction into an end position, while:

the guiding body is force-fittingly connected to the socket spanner for a synchronous movement in a movement direction, an inclined surface of the unlock-action pairing and the inclined surface of the drive-out-action pairing are aligned, so that by a movement of the socket spanner in the movement direction, the locking pin is driven-out into its locking position, and the sliding body is form-fittingly blocked in its end position by blocking the sliding body in the movement direction and blocking the guiding body in an opposite direction.

5. The locking device according to claim 1, wherein the locking device is integrated in a switch machine for adjusting the two switching blades of a switch in one of two installation positions and for form-fittingly locking the switch blade locating in one of the installation positions, wherein the switch machine is located between the two switch blades and is connected to both switch blades through an adjusting rod, wherein the adjusting rod is divided into two aligned and longitudinally-movable sliding bodies, one of which forms said sliding body, each of said sliding bodies is fixedly connected to one of the switch blades, wherein the sliding bodies oppositely lie in the switch machine with their free insertion ends essentially coaxially aligned, wherein in each of the two oppositely lied insertion ends of the sliding bodies, in each case, said socket spanner and said locking device are plunged and slidingly guided between a deep plunge depth and a low plunge depth, wherein the socket spanners are doubly applied to a central body as the rod-shaped extensions by mirroring at a central radial plane of the central body with correspondingly opposite function of their locking devices, wherein the pockets of the socket spanners are formed at the locking devices and the surfaces and/or edges of the unlocking and driving-out action pairings are aligned, so that at a greater plunge depth, a driving-out surface is configured to drive the locking pin into the locking position, and at a lower plunge depth, a driving-in surface is configured to drive the locking pin into the neutral position, and generates an operative connection of the push-action pairing, wherein the central body with the rod-shaped extensions as well as the oppositely lying insertion ends of the two sliding bodies are coaxially guided in the common guiding body, wherein, for operating the switch blades in their respective installation positions, the guiding body is longitudinally drivable by the switch machine and force-fittingly connected to the central body, and wherein the guiding body in each of the two installation positions of the switch blades can be form-fittingly fixed by a blocking device of the switch machine in the opposite direction to an application direction, wherein by operating the guiding body in the application direction and the central body with its socket spanners relative to the insertion ends, the sliding body is movable, while increasing the depth of plunge of one of the socket spanners in the application direction, wherein by the operative connection of the push-action pairing, this socket spanner pushes its locking pin into its locking position, and thereby this socket spanner is form-fittingly connected to the guiding body, and wherein, by driving up the switch when overcoming a form-fitting connection to the guiding body blocked in a driving-up direction, form-fitting can be generated between the switch blades via the sliding body, connecting them, and by an operative connection of the locking pin located in the neutral position to a respective one of the pushing edges, the push-action pairing is generated, wherein:

a remote one of the switch blades and its sliding body are movable in the opposite direction to the application direction relative to the other one of the socket spanners in the application direction while reducing the plunge depth, the locking pin of this socket spanner is pressed by an operative connection to the sliding body via the unlock-action pairing into its neutral position, and via the push-action pairing in the opposite direction to the application direction between the sliding body of the remote switch blade and the socket spanner, and wherein by the movement of the socket spanner in the driving-up direction, the other one of the socket spanners is movable relative to the sliding body of the switch blade adjacent thereto, while reducing the depth of plunge, and the locking pin is pressed through the operative connection to this sliding body via the drive-in-action pairing in its neutral position, and via the push-action pairing, also this socket spanner effects the form-fitting with the sliding body.

6. The locking device according to claim 1, wherein the first operation direction for the straight guidance of the locking pin is inclined at 45°.

7. The locking device according to claim 1 the second operating direction for the straight guide of the locking pin is inclined at 45°, and wherein the one driving out surface is inclined relative to the straight guide of the locking pin at 45°.

* * * * *